US007293312B2

(12) United States Patent
Chmelar

(10) Patent No.: US 7,293,312 B2
(45) Date of Patent: Nov. 13, 2007

(54) MULTIPURPOSE SKATEBOARD TOOL

(76) Inventor: Erik Vaclav Chmelar, 371 Elan Village La., Apt 112, San Jose, CA (US) 95134

( * ) Notice: Subject to any disclaimer, the term of this patent is extended or adjusted under 35 U.S.C. 154(b) by 142 days.

(21) Appl. No.: 11/242,462

(22) Filed: Oct. 4, 2005

(65) Prior Publication Data

US 2007/0074351 A1 Apr. 5, 2007

(51) Int. Cl.
*B25F 1/00* (2006.01)

(52) U.S. Cl. ..... 7/165; 81/177.85; 81/177.2; 81/180.1; 81/124.4; 81/176.2; 7/138

(58) Field of Classification Search ..... 7/165, 7/138; 81/176.2, 124.4, 177.2, 177.85, 180.1, 81/124.2, 176.1
See application file for complete search history.

(56) References Cited

U.S. PATENT DOCUMENTS 2,445,905 A * 7/1948 Busby ..... 81/124.3
3,002,409 A * 10/1961 Jones ..... 81/177.2
3,086,414 A * 4/1963 Nardi ..... 81/176.1
D243,506 S 3/1977 Hess
4,237,754 A * 12/1980 Battrick ..... 81/439
4,325,275 A * 4/1982 Colvin ..... 81/77
4,409,866 A * 10/1983 McBride ..... 81/177.2
4,512,693 A * 4/1985 Swanson ..... 408/239 R
4,631,770 A * 12/1986 Goldberg ..... 7/167
4,774,736 A * 10/1988 Brawner et al. ..... 7/138
4,926,721 A 5/1990 Hsiao
4,960,016 A * 10/1990 Seals ..... 7/138
5,285,543 A 2/1994 Rowe
5,303,439 A * 4/1994 Seals ..... 7/138
5,365,811 A 11/1994 Chi
5,524,513 A 6/1996 Barahona
5,632,056 A * 5/1997 Hsiao ..... 7/138
5,743,737 A * 4/1998 Hawn et al. ..... 433/141
5,778,896 A 7/1998 Seals et al.
5,983,760 A 11/1999 Clarke
6,062,111 A * 5/2000 Wershe ..... 81/177.4
6,199,456 B1 * 3/2001 Hlady ..... 81/177.2
6,272,708 B1 * 8/2001 Chen ..... 7/105
6,279,434 B1 * 8/2001 Brown ..... 81/437
6,286,397 B1 * 9/2001 Taggart et al. ..... 81/63.1
6,374,708 B1 * 4/2002 Kunz ..... 81/124.2
6,502,483 B1 * 1/2003 Swank et al. ..... 81/437
6,564,679 B1 * 5/2003 Llamas et al. ..... 81/176.15
6,698,317 B1 * 3/2004 Machovsky ..... 81/124.2
D490,284 S * 5/2004 McElligott et al. ..... D8/21
6,865,760 B2 * 3/2005 Oberndorfer ..... 7/138

* cited by examiner

*Primary Examiner*—Joseph J. Hall, III
*Assistant Examiner*—Robert Scruggs

(57) ABSTRACT

A compact multipurpose tool including a bit head, a hollow first cylinder that defines a plurality of open-end wrenches on one end, and a second cylinder that communicates with the bit head and can be at least partially housed within the hollow first cylinder. In further features the hollow first cylinder defines a socket on the end opposite the plurality of open-end wrenches and the second cylinder includes a plurality of sockets.

3 Claims, 2 Drawing Sheets

MULTIPURPOSE SKATEBOARD TOOL

BACKGROUND OF THE INVENTION

The present invention is a multipurpose tool for use with skateboards, in-line skates, bicycles, or other sporting equipment that may require assembly, adjustment, or repair. Such sporting equipment may require several different types of tools. For example, assembly, adjustment, or repair of a typical skateboard may require a ⅜ inch socket or wrench, a ½ inch socket or wrench, a 9/16 inch socket or wrench, and a screwdriver with a Phillips or Allen head. A sporting enthusiast would prefer to have a compact multipurpose tool to assemble, adjust, or repair his or her equipment instead of a plurality of separate tools. Consequently, there have been many attempts at developing multipurpose tools that incorporate several tools in a compact form.

U.S. Pat. No. D490,284 (McElligot, et. al.) discloses an ornamental design for a skate tool, which is generally shaped as a cylinder, consisting of a first cylindrical portion, a second cylindrical portion normally housed in said first cylindrical portion, said second cylindrical portion including a provision to permit said second cylindrical portion to pivot on one end to cause said second cylindrical portion to be generally perpendicular to said first cylindrical portion, and a removable tool bit housed in said second cylindrical portion.

U.S. Pat. No. 6,286,397 (Taggart, et. al.) discloses a portable multipurpose tool including tools useful for fixing or adjusting equipment used by a person engaged in in-line skating, a board sport, or the like, wherein the various implements are conveniently stored within a tool housing and wherein at least one of the tools is a socket wrench.

U.S. Pat. No. 6,279,434 (Brown) discloses a tool for use on a skateboard that has a body in the general shape of a T, having a crossbar bisected by a stem, and providing for three sockets of differing sizes, one of each mounted at each end of the crossbar and the free end of the stem.

U.S. Pat. No. 6,062,111 (Wershe) discloses a portable tool assembly having a flat carrying case, said case having a groove along an edge side to snap-fit an Allen wrench in place, and an opposite edge side to snap-fit tool bits, counter-bores to seat the tool bits in a non-rotatable and usable position such that the case serves as a handle for the tool kit, and a key ring loop that extends from another edge side.

U.S. Pat. No. 5,983,760 (Clarke) discloses a skate key assembly for adjusting the wheels of an in-line skate, comprising an elongated one-piece key member of uniform hexagonal cross section including an intermediate S-shaped gripping member extending in one direction to a generally straight operating portion having a terminal end for insertion into the tightening mechanism of a wheel of the in-line skate and extending in an opposite direction to an attachment portion oriented generally transverse to said operating portion.

U.S. Pat. No. 5,778,896 (Seals, et. al.) discloses a pipe for use in smoking tobacco, including a hollow stem having a mouth end structured as a small socket for grasping nuts and bolt heads, and a removable screwdriver rod for holding said pipe.

U.S. Pat. No. 5,524,513 (Barahona) discloses a tool for use in removing a wheel and bearings of an in-line skate, comprising a handle, said handle including a first cavity extending longitudinally therein from one end of said handle, said first cavity housing a detachable Allen wrench, three concentrically mounted and staggered levels having different diameters that extend longitudinally from said handle from the end opposite said first cavity, and an Allen wrench tip mounted on the third level of said concentric levels.

U.S. Pat. No. 5,365,811 (Chi) discloses a single unit multipurpose hand tool structured to allow manipulating of fasteners and the removal of wheel bearings on in-line roller skates, said hand tool including a rigid plastic center handle structured of a three-armed star having flattened distal ends from which metal tool tips extend.

U.S. Pat. No. 5,285,543 (Rowe) discloses a combination tool device having a double-ended socket wrench, a handle with a screwdriver tip, and a file disposed in said handle.

U.S. Pat. No. 4,926,721 (Hsiao) discloses a concealed and built-up type multipurpose hand tool structure that includes a hollow T-shaped handle for storing a variety of sockets, said handle having middle through-holes to receive therein a variety of hexagonal wrenches or driver heads of other cylindrical tool parts.

U.S. Pat. No. 4,774,736 (Brawner, et. al.) discloses a tool kit that has two parts which inter-fit together and are held together inside a generally flexible case that is designed to be entrained on the belt of a skateboarder, one of said two parts defines three differently sized sockets and the other of said two parts mounts an Allen wrench and a pair of screwdriver heads.

U.S. Pat. No. D243,506 (Hess) discloses an ornamental design for a skateboard adjustment tool that includes a cylindrical portion and a plurality of flat arms mounted perpendicularly to said cylindrical portion.

Many of the previous multipurpose tools do not include a sufficient number of the tools that may be required for assembly, adjustment, or repair of the user's equipment. Additionally, many of the previous multipurpose tools can be bulky and awkward to carry, often shaped as a non-compact "T" or cross. Furthermore, many of the previous multipurpose tools include a very small removable Phillips or Allen key that can be difficult to use and easy to lose. Finally, many of the previous multipurpose tools include swiveling or pivoting parts that may be susceptible to damage or breakage.

Accordingly, what is desired, and has not heretofore been developed, is a multipurpose tool that incorporates a sufficient number of the tools that may be required for assembly, adjustment, or repair of equipment such as a skateboard, is compact and generally cylindrical in shape to facilitate convenient carrying in a pocket, is devoid of swiveling or pivoting parts that may be prone to damage or breakage, and is devoid of very small detachable Phillips or Allen keys that may be difficult to use and easy to lose.

BRIEF SUMMARY OF THE INVENTION

It is an object of the present invention to provide a multipurpose tool.

It is an object of the present invention to provide a compact and generally cylindrical multipurpose tool.

It is an object of the present invention to provide a multipurpose tool devoid of breakable swiveling or pivoting parts.

It is an object of the present invention to provide a multipurpose tool devoid of difficult-to-use detachable Phillips or Allen keys.

It is an object of the present invention to provide a multipurpose tool that includes at least one bit head, a hollow first cylinder defining a plurality of open-end wrenches on one end, and a second cylinder that communicates with said bit head.

It is an object of the present invention to provide a multipurpose tool that includes at least one bit head, a hollow first cylinder that defines a plurality of open-end wrenches on one end, and a second cylinder that communicates with said bit head, wherein said second cylinder can be at least partially housed within said hollow first cylinder.

It is an object of the present invention to provide a multipurpose tool that is inexpensive to manufacture.

It is an object of the present invention to provide a multipurpose tool that is easy to use.

In the above objects, and hereafter, the term "bit head" describes an arbitrary type of screwdriver head, such as a Phillips or Allen head; the term "bit" describes an element that defines at least one bit head; the term "cylinder" describes an elongated element of arbitrary cross-sectional shape; the term "open-end wrench" describes an opening that can communicate with a fastener, such as a bolt or nut; and the term "socket" describes a cavity that can communicate with a bit or fastener, such as a bolt or nut.

The above objects, features, and advantages of the present invention will become apparent from the following detailed description when read in conjunction with the accompanying drawings, which illustrate by way of example, the principles of the invention. The same reference numerals are used to identify the same or similar parts in each of the accompanying drawings.

DETAILED DESCRIPTION OF THE INVENTION

Figure 1:
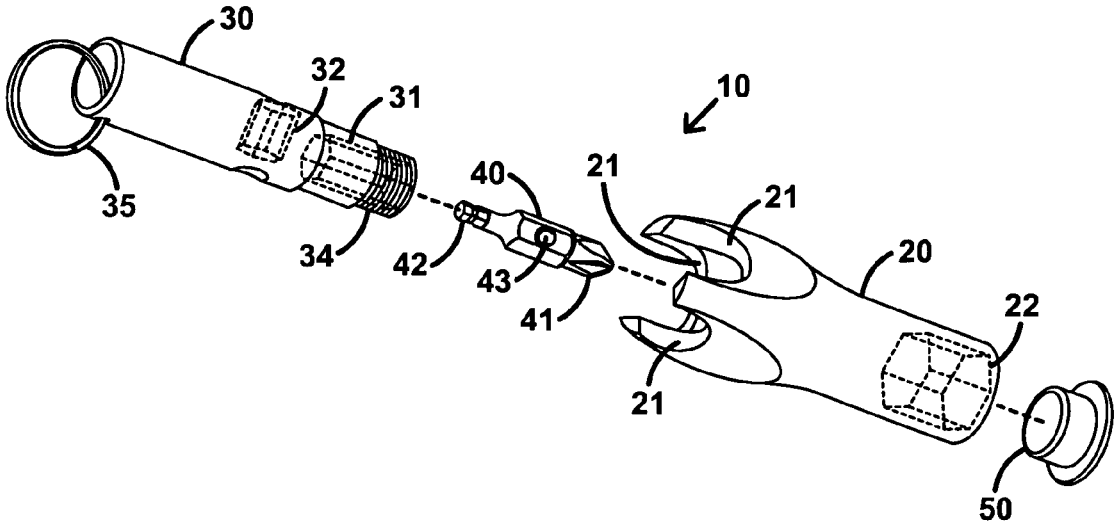
FIG. 1 shows a perspective view of the preferred embodiment of the multipurpose tool.

FIG. 1 shows a perspective view of the preferred embodiment of the multipurpose tool 10, including a hollow first cylinder 20, a second cylinder 30, and a bit 40. The second cylinder 30 may communicate with the bit 40 via the socket 31 as shown in FIG. 1, FIG. 2*c*, FIG. 3*c*, and FIG. 4, and the second cylinder 30 may be at least partially housed within the hollow first cylinder 20 as shown in FIG. 2*a*, FIG. 2*b*, FIG. 2*c*, and FIG. 3*c*.

The hollow first cylinder 20 defines a plurality of open-end wrenches 21 on one end as shown in FIG. 1, FIG. 2*a*, FIG. 2*b*, FIG. 2*c*, FIG. 3*a*, FIG. 3*c*, and FIG. 4. The hollow first cylinder 20 may define a socket 22 on the end opposite the plurality of open-end wrenches 21 as shown in FIG. 1, FIG. 2*c*, FIG. 3*a*, FIG. 3*c*, and FIG. 4.

Figure 4:
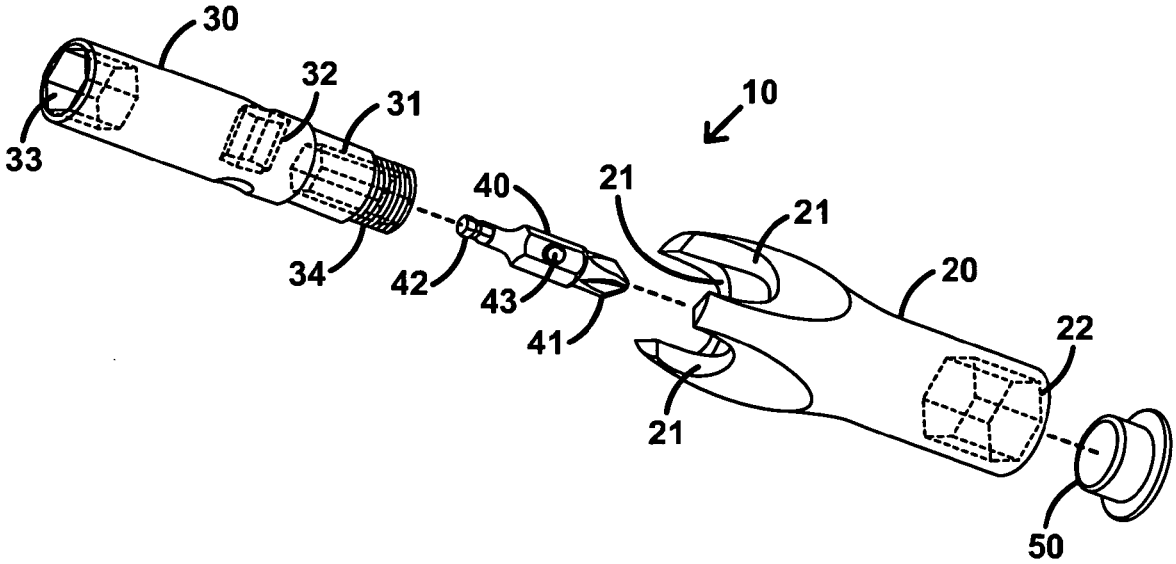
FIG. 4 shows a perspective view of an alternate embodiment of the multipurpose tool wherein the second cylinder includes an additional socket.

A ball and spring 43, as shown in FIG. 1 and FIG. 4, may be used to secure the bit 40 to the second cylinder 30, although other means of securement, such as magnetism, may be used instead of or in addition to the ball and spring 43. The bit 40, which is shown to include both a first bit head 41 and a second bit head 42 in FIG. 1, FIG. 2*d*, and FIG. 4, may be arbitrarily configured to include only one head, in which case the bit 40 can be permanently secured to, or defined on, the second cylinder 30.

Figure 2A:
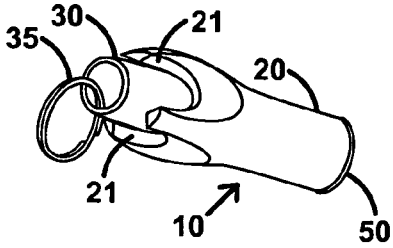
FIG. 2*a*, FIG. 2*b*, and FIG. 2*c* show perspective views of the multipurpose tool configured with the second cylinder partially housed within the hollow first cylinder.
Figure 2B:
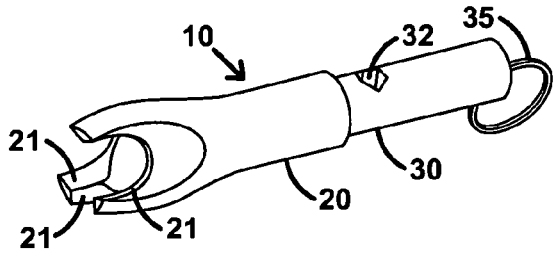
Figure 2C:
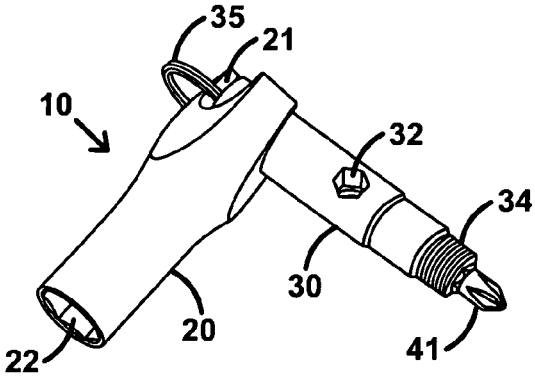
Figure 2D:
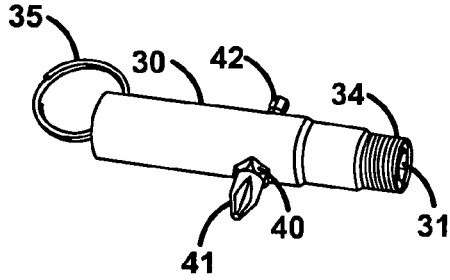
FIG. 2*d* shows a perspective view of the second cylinder communicating with the bit in an alternate configuration.

An additional socket 32, as shown in FIG. 1, FIG. 2*b*, FIG. 2*c*, FIG. 3*b*, FIG. 3*c*, and FIG. 4, may be defined on the second cylinder 30 as an alternate means of communicating with the bit 40 as shown in FIG. 2*d*.

Figure 3A:
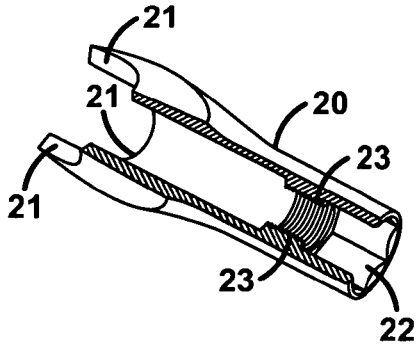
FIG. 3*a* and FIG. 3*b* show cut-away perspective views of the hollow first cylinder and the second cylinder, respectively.
Figure 3B:
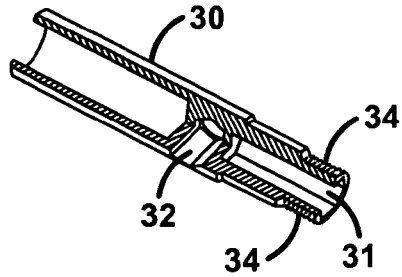
Figure 3C:
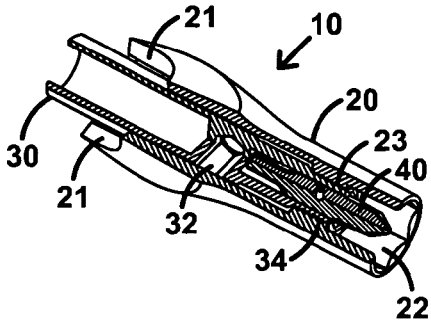
FIG. 3*c* shows a cut-away perspective view of the second cylinder partially housed within the first cylinder, wherein the second cylinder is communicating with the bit.

A threaded portion 23 may be defined on the hollow first cylinder 20, as shown in FIG. 3*a*, and a threaded portion 34 may be defined on the second cylinder 30, as shown in FIG. 1, FIG. 2*c*, FIG. 2*d*, FIG. 3*b*, and FIG. 4, which may communicate to secure the hollow first cylinder 20 to the second cylinder 30 as shown in FIG. 2*a*, FIG. 2*b*, and FIG. 3*c*. Other means of securing the hollow first cylinder 20 to the second cylinder 30, such as magnetism or a ball and spring, may be used instead of or in addition to the threaded portion 23 and the threaded portion 34.

FIG. 1, FIG. 2*a*, and FIG. 4 show a removable cap 50 that may be secured to the hollow first cylinder 20 to help prevent loss of the bit 40 when the second cylinder 30 is at least partially housed within the hollow first cylinder 20 as shown in FIG. 2*a*.

FIG. 1, FIG. 2*a*, FIG. 2*b*, FIG. 2*c*, and FIG. 2*d* show a ring 35 that may be included with the multipurpose tool 10 to facilitate convenient carrying.

Although a specific embodiment of the present invention has been illustrated and described, many variations or modifications would be apparent that do not depart from the spirit and scope of the invention. For example, FIG. 4 shows an alternate embodiment of the multipurpose tool 10 in which the second cylinder 30 defines a socket 33 on the end opposite the bit 40.

The following claims completely define the present invention.

The invention claimed is:

1. A multipurpose tool comprising:

a screwdriver bit;

a hollow first cylinder including a first end, a second end, an outer surface and an inner surface, said first end defining a plurality of open-end wrenches formed within the periphery of said outer surface, said second end defining a socket within said inner surface, said inner surface including a means of securement adjacent to said socket for securement to a second cylinder; and said second cylinder including a first end, a second end, a middle portion formed therebetween, an outer surface and an inner surface, said first end of said second cylinder having an outer diameter smaller than the inner diameter of said first end of said hollow first cylinder and smaller than an across-flats diameter of said socket defined within said inner surface of said second end of said hollow first cylinder, said middle portion having an outer diameter smaller than the inner diameter of said first end of said hollow first cylinder and smaller than the across-flats diameter of said socket defined within said inner surface of said second end of said hollow first cylinder, said second end of said second cylinder having an outer diameter smaller than the inner diameter of said first end of said hollow first cylinder, said first end of said second cylinder including a socket extending therein for receiving said screwdriver bit and including a means for securing said screwdriver bit within said socket, said first end of said second cylinder also including a means of securement for cooperating with said means of securement of said inner surface of said hollow first cylinder, said second end of said second cylinder including a socket that extends perpendicularly through said inner and outer surfaces of said second cylinder, and said second end of said second cylinder being defined to cooperate with at least one of said plurality of open-end wrenches.

2. The multipurpose tool of claim 1 wherein said second end of said second cylinder includes a split ring.

3. The multipurpose tool of claim 1 wherein said inner surface of said second end of said second cylinder defines a socket.

* * * * *